United States Patent [19]

Bascou

[11] 4,350,376

[45] Sep. 21, 1982

[54] LOCKING DEVICE FOR SWIVELING WINDOW

[75] Inventor: Jacques Bascou, Boulogne, France

[73] Assignee: Regie Nationale des Usines Renault, Boulogne-Billancourt, France

[21] Appl. No.: 206,546

[22] PCT Filed: Oct. 29, 1979

[86] PCT No.: PCT/FR79/00098

§ 371 Date: May 13, 1980

§ 102(e) Date: May 13, 1980

[87] PCT Pub. No.: WO80/00017

PCT Pub. Date: Jan. 10, 1980

[30] Foreign Application Priority Data

Nov. 3, 1978 [FR] France ..... 78 31210

[51] Int. Cl.[3] ..... E05C 17/32

[52] U.S. Cl. ..... 292/263; 49/192; 49/278; 292/278

[58] Field of Search ..... 292/263, 262, 278; 49/192, 276–278

[56] References Cited

U.S. PATENT DOCUMENTS

| | | | |
|---|---|---|---|
| 1,494,403 | 5/1924 | Ayres | 292/263 |
| 4,206,939 | 6/1980 | Rowley | 292/263 |

FOREIGN PATENT DOCUMENTS

| | | | |
|---|---|---|---|
| 1099391 | 2/1961 | Fed. Rep. of Germany | 292/262 |
| 1153187 | 3/1958 | France | 292/263 |
| 246075 | 1/1926 | United Kingdom . | |
| 364908 | 1/1932 | United Kingdom | 292/263 |
| 1437482 | 5/1976 | United Kingdom | 292/263 |

*Primary Examiner*—William E. Lyddane

*Attorney, Agent, or Firm*—Oblon, Fisher, Spivak, McClelland & Maier

[57] ABSTRACT

The invention concerns a device for locking a swiveling window in a closed or partially open position. The device includes a rod (4) articulated (i) so as to slide within a handle or control lever (1) mounted so as to pivot on a rest (2), and (ii) to a yoke (6) mounted with a certain degree of rotation in a base (8) affixed to the window (9), and a mechanism for locking/unlocking the lever in the closed or partially open positions of window (9).

2 Claims, 8 Drawing Figures

LOCKING DEVICE FOR SWIVELING WINDOW

TECHNICAL FIELD

The present invention relates to a device enabling a swiveling window to be locked in closed or partially open position, particularly a swiveling window for an automobile.

BACKGROUND ART

In the prior art, locking devices for swiveling windows are known generally to include two articulated links, disposed facing the pivot axis of the window. Among the disadvantages of such devices may be cited the lack of leaktightness they provide the window, due to a loss of pressure on the leaktight seal following disalignment of the points of articulated of the links necessary for locking the window. In addition, the path of the control rod during operation causes a protrusion into the interior of the vehicle, entailing risks of danger when the partial opening of the window is positioned at only half its travel.

DISCLOSURE OF INVENTION

The present invention is intended to remove the disadvantages of prior art systems by providing a locking device during the operation of which the leaktight seal will remain at a constant level of compression.

The locking device according to the invention is characterized by the fact that it includes a rod, articulated (i) so as to slide in a handle or control lever mounted so as to pivot on a rest, and (ii) at a yoke mounted with a certain degree of rotation in a base affixed to the window, and a mechanism for locking-/unlocking the lever in the closed or partially opened positions of the window. The locking mechanism advantageously includes a set of cams shaped so as to come either into abutment or into sliding contact with one of the cams being integral with the handle while the other is fastened integrally to the yoke.

This embodiment enables the control lever to be maintained at a constant distance from its rest position during rotational movement.

With a quarter-turn rotation, such a device enables rapid locking and unlocking, making possible its adaptation to a servo-control mechanism, e.g., a motor element, in order to automate the assembly.

Various other objects, features and attendant advantages of the present invention will be more fully appreciated as the same becomes better understood from the following detailed description when considered in connection with the accompanying drawings in which like reference characters designate like or corresponding parts throughout the several views and wherein.

BEST MODE FOR CARRYING OUT THE INVENTION

Figure 3:
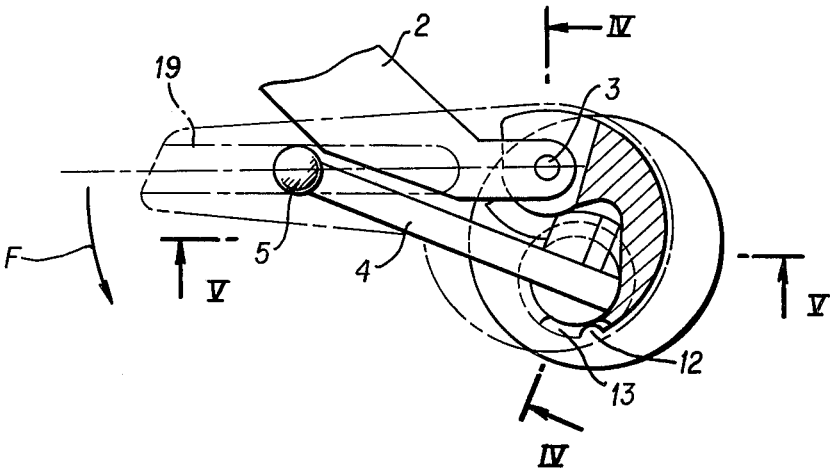
FIG. 3 is a cross-sectional view taken along III—III of FIG. 4.

The locking device according to the invention includes control a handle 1 pivotably mounted on a lock body rest 2 via an axle member 3 traversing it. A driving rod 4 is provided at one end thereof, with a ball 5 mounted so as to slide in an oblong housing of elongated channel 19 provided on the inner lateral surface of control handle 1. At its other end, rod 4 is jointed to a yoke 6 through axle member 7, perpendicular to pivot axis 3 of control handle. Yoke 6, positioned in recess 18 of handle 1, is mounted so as to swivel on a base 8 fastened onto window 9 essentially parallel to rest 2, by means of a screw-nut system 10, 11. Locking of the system is performed by two cams 14, 17 shaped so as to overlap. Cam 14, integral with yoke 6, is, in a locked position, in contact through its lower surface 15 with the upper part 16 of cam 17, which is integral with handle 1. By rotation of control handle 1 in the direction of arrow F, which causes yoke 6 to swivel within base 8, movement which is limited by a notch 13 provided on a shoulder of the yoke 6, the end of which comes into contact with a stop 12 integral with base 8, cams 14 and 17 are unlocked, thus unlocking the assembly (see FIGS. 3 and 7).

Figure 6:
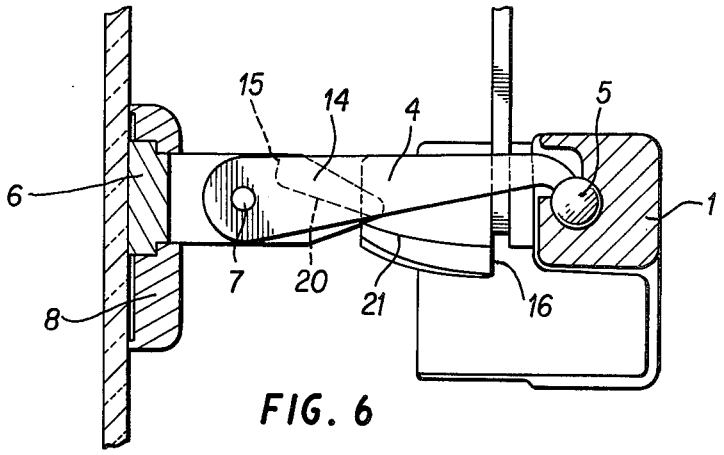
FIG. 6 is a cross-sectional view taken along VI—VI of FIG. 8, illustrating the locking of the system in the partially open position of the window.
Figure 8:
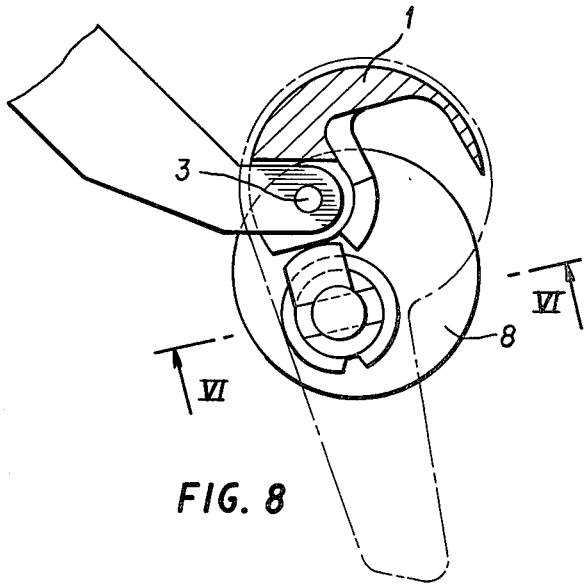
FIG. 8 is a partial cross-sectional view taken illustrating the locking of the system in the partially opened position of the window.

To open the window partially, one continues rotating operation of handle 1, which induces ball 5 to slide within its housing 19 while rod 4 swivels about axis 7, arriving at the position shown in FIGS. 6 and 8. Locking in this half-open position is obtained because rod 4 is perpendicular to the rest plane of handle 1. Return forces tending to close the window, exerted on rod 4, therefore cannot cause handle 1 to pivot, since in this position the rotational torque is cancelled out.

Closing of the window is done by rotating handle 1 in a direction opposite that of arrow F so as to cause rod 4 to pivot about its axle member 7, while gradient 20 of cam 14 enters into sliding contact with gradient 21 of cam 17, which assures return through rotation of yoke 6 in recess 18 in handle 1.

To return to the locked position, with the window closed, the operator continues rotating operation of handle 1 in the opposite direction of arrow F, with this movement driving rod 4, which causes yoke 6 to pivot in base 8. Gradient 20 continues to slide on gradient 21, until lower surface 15 of cam 14 comes into contact with upper surface 16 of cam 17, thus ensuring positive locking of yoke 6 in housing 18 of handle 1.

In other words, in operation of the device of the present application, the rod 4 is attached for swivel motion to the ball 5 which slides axially in the housing 19 of the control handle 1 which forms the rotating handle. The rod 4 is also pivotably attached by means of an axle member 7 at its other end to the arms of a yoke 6, having limited rotation, driven by the handle 1 in a base 8 fixed to the window 9. The control handle 1 is itself pivotably mounted on body rest 2 on the car body by means of an axle 3.

First cam 14 is provided, integral with the yoke 6 and second cam 17, integral with the handle 1. The two cams 14, 17 have their respective faces 15, 16 and bearing against one another in the closed and locked position of the window. The faces 15, 16 bear against one another during the rotation of the yoke 6 driven by the rotational movement of the handle 1 until stop 12 and notch 13 arrest the movement of the yoke 6 in the base 8.

The surfaces 15, 16 which have been bearing against one another then separate, and gradients 20, 21, provided on cams 14, 17 respectively, then come into sliding contact with one another. The rod 4, pivoted on the yoke 6, slides in the housing 19 of the control handle 1 during rotation in the same direction as the handle to a position of the rod 4 practically perpendicular to the fixed plane of the handle, when the window is partially open.

Figure 1:
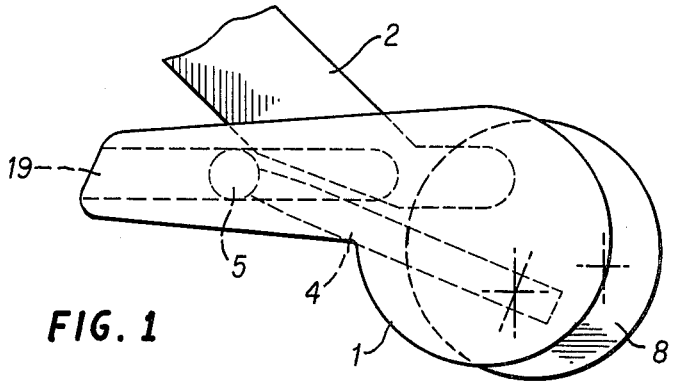
FIG. 1 is a side view of the system in locked position, window closed.
Figure 2:
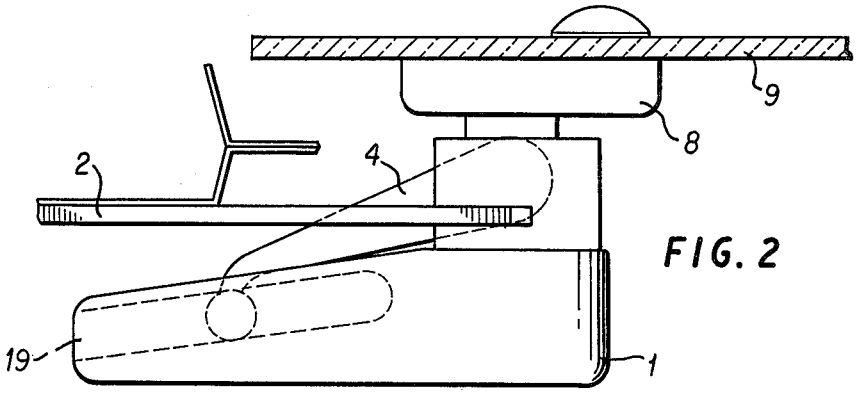
FIG. 2 is a top view of the system of FIG. 1.
Figure 4:
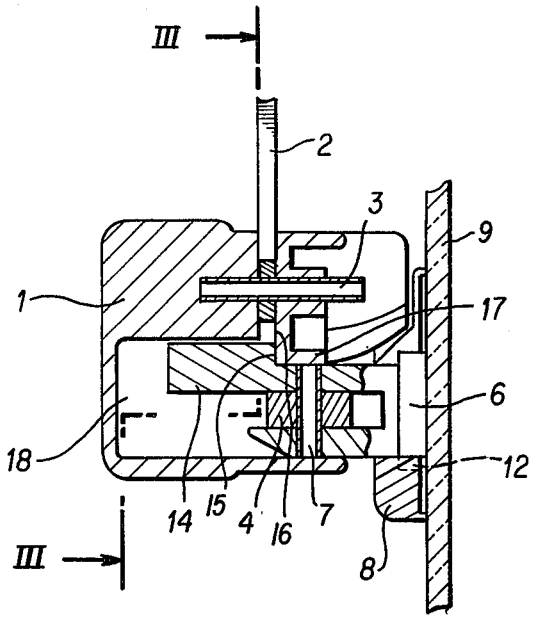
FIG. 4 is a cross-sectional view taken along IV—IV of FIG. 3.

The swiveling window lock of the invention is assembled as follows:

The complete lock, as represented in FIG. 1, is preparatively mounted onto window 9 in its theoretical position and is fastened by screw 10 and nut 11 (FIG. 4).

Figure 5:
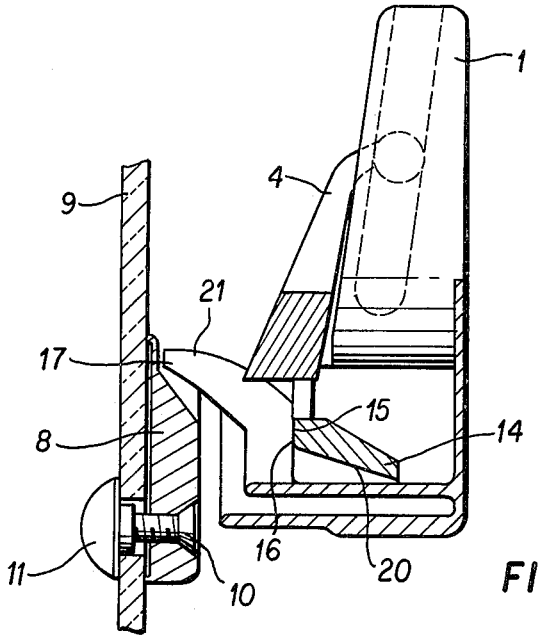
FIG. 5 is a cross-sectional view taken along V—V of FIG. 3.
Figure 7:
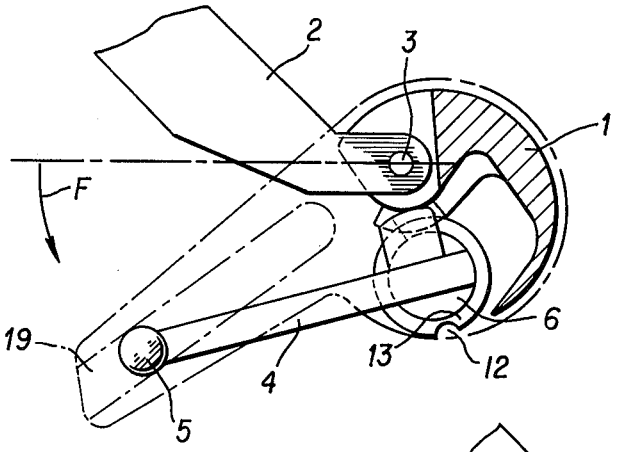
FIG. 7 is a partial cross-sectional view taken illustrating unlocking of the system.

The window is next fastened on the hinge side and, in order to fasten lock rest 2 onto the body, the lock must be placed in the position represented in FIGS. 5 and 7. Before tightening the fastening screws for lock rest 2, the lock must be placed in locked position, thus placing the assembly in the position shown in FIG. 1.

Obviously, numerous modifications and variations of the present invention are possible in light of the above teachings. It is therefore to be understood that within the scope of the appended claims, the invention may be practiced otherwise than as specifically described herein.

I claim:

1. A device for locking a swiveling window in a closed and partially opened position comprising:

a base mounted to said window;

a body rest member;

a control lever pivotably mounted on said rest member and having an elongated channel formed therein;

a yoke member rotatably mounted on said base;

a driving rod having a first end thereof pivotably mounted to said yoke member and a second end thereof slidably mounted within said channel of such control lever; and means operably connected to said control lever and said yoke for locking and unlocking of said control lever in said closed and partially opened position wherein said means for locking and unlocking said control lever further comprises a first and second cam for mutual abutment and sliding contact, said first cam being integrally formed with said yoke and said second cam being integrally formed with said control handle.

2. A device for locking a swiveling window in a closed and partially open position comprising:

a base mounted to said window;

a body rest member;

a control lever pivotably mounted on said rest member and having an elongated channel formed therein;

a yoke member rotatably mounted on said base;

a driving rod having a first end thereof pivotably mounted to said yoke member and a second end thereof slidably mounted within said channel of said control lever;

means operatably connected to said control lever and said yoke for locking and unlocking of said control lever in said closed and partially open position wherein said yoke includes a shoulder member; and means for limiting rotation of said yoke which includes a notch formed in said shoulder of said yoke and a stop integrally formed with said base wherein said stop is engageable with said notch.

* * * * *